US005906422A

United States Patent [19]

Golias, Sr.

[11] Patent Number: 5,906,422

[45] Date of Patent: May 25, 1999

[54] INSERT PANEL SUPPORT STRUCTURE

[75] Inventor: Bernard J. Golias, Sr., Hinckley, Ohio

[73] Assignee: Metal Fabricating Corporation, Cleveland, Ohio

[21] Appl. No.: 08/985,099

[22] Filed: Dec. 4, 1997

[51] Int. Cl.[6] ..... A47B 88/04

[52] U.S. Cl. ..... 312/334.7; 312/334.12

[58] Field of Search ..... 312/334.7, 334.12, 312/334.13, 334.18, 334.21, 334.1

[56] References Cited

U.S. PATENT DOCUMENTS

| | | | |
|---|---|---|---|
| 1,508,259 | 9/1924 | Stafford | 312/334.4 X |
| 1,523,653 | 1/1925 | Larson et al. | 312/263 |
| 1,569,158 | 1/1926 | Tobey . | |
| 1,906,832 | 5/1933 | Bales et al. | 312/334.13 X |
| 1,910,208 | 5/1933 | Gronberg et al. . | |
| 2,157,611 | 5/1939 | Jones et al. . | |
| 2,212,191 | 8/1940 | Dietz | 312/334.18 |
| 2,331,529 | 10/1943 | Wolters et al. . | |
| 2,350,228 | 5/1944 | Hanes . | |
| 2,496,997 | 2/1950 | Hallberg . | |
| 2,572,081 | 10/1951 | Wallance | 312/334.7 X |
| 2,620,252 | 12/1952 | Restivo . | |
| 2,750,052 | 6/1956 | Brown et al. . | |
| 2,914,370 | 11/1959 | Hensch et al. . | |
| 3,219,405 | 11/1965 | Costantini et al. . | |
| 3,241,902 | 3/1966 | Hamilton et al. . | |
| 4,440,461 | 4/1984 | Powell et al. . | |
| 5,262,923 | 11/1993 | Batta et al. | 312/334.7 X |
| 5,470,143 | 11/1995 | Gill . | |
| 5,470,144 | 11/1995 | Wen . | |
| 5,520,452 | 5/1996 | Petersen et al. | 312/334.12 |
| 5,624,171 | 4/1997 | Soja et al. . | |

FOREIGN PATENT DOCUMENTS

| | | | |
|---|---|---|---|
| 0204767 | 10/1923 | United Kingdom | 312/334.7 |

*Primary Examiner*—Peter M. Cuomo
*Assistant Examiner*—David E. Allred
*Attorney, Agent, or Firm*—Fay, Sharpe, Beall, Fagan, Minnich & McKee

[57] ABSTRACT

A cabinet structure includes first and second inner side panels (40*a*,40*b*) positioned respectively on opposite first and second lateral sides of the cabinet. Each of the side panels includes a generally vertical inner face (50) and a vertically extending V-shaped ridge (70) having at least one drawer support rail receiving notch (84) formed therein. At least first and second drawer support rails (80) are connected respectively to the first and second inner side panels (40*a*, 40*b*). Each of the rails is positioned in one of the support rail receiving notches and generally horizontally extends from a cabinet front region (20) to a cabinet rear region (42). A drawer (30) is movably connected to the drawer support rails and moves between an open position extending from the cabinet and a closed position within the cabinet.

8 Claims, 3 Drawing Sheets

INSERT PANEL SUPPORT STRUCTURE

BACKGROUND OF THE INVENTION

The present invention relates generally to storage cabinets and the like, and more particularly to an insert panel support structure for a storage cabinet which strengthens the cabinet structure and facilitates cabinet assembly.

With reference to FIG. 1, it is generally known to provide a cabinet structure A into which one or more sliding drawers B are received. In certain applications, the drawers are compartmentalized or otherwise configured to hold screws, nuts, bolts, and other articles. For example, a compartmentalized storage box C (FIG. 2) may be adapted to rest on a cabinet drawer B. The storage of such articles in this manner often times leads to the drawers B being heavily loaded. As such, the drawers and the cabinet structure must be sufficiently strong to withstand the weight. Of course, the cabinet must also be affordable and is preferably relatively easy to move about. Therefore, the materials used in the cabinet structure must be strong, but not too thick, heavy, or expensive.

With these prior cabinet structures A, there has been found a tendency for the cabinet side walls D (only one shown), located on opposite lateral cabinet sides, to "bow" or flex outward under the weight of the drawers B. This flexing renders drawer movement difficult and can lead to cabinet damage. Furthermore, many prior cabinet structures of the type described rely upon simple spot-welding to affix the drawer support rails E to the left and right inner cabinet panels F located inwardly adjacent the left and right sidewalls D, respectively. While spot welding is well suited for light loads, when the drawers are heavily loaded, the spot welds are not sufficiently strong and may fail.

Prior attempts to solve the above-noted and other deficiencies of known cabinet structures have not been found to be entirely effective or commercially viable. Complex and heavily reinforced structures increase cabinet weight and cost, and increase assembly time. Thus, there has been found a need for a cabinet structure that overcomes the above-noted deficiencies and others while also providing a low-cost and easily assembled structure.

SUMMARY OF THE INVENTION

In accordance with a first aspect of the present invention, a cabinet structure includes first and second inner side panels positioned respectively on opposite first and second lateral sides of the cabinet. Each of the side panels includes a generally vertical inner face and a vertically extending V-shaped ridge having at least one drawer support rail receiving notch formed therein. At least first and second drawer support rails are connected respectively to the first and second inner side panels. Each of the rails is positioned in one of the support rail receiving notches and generally horizontally extends from a cabinet front region to a cabinet rear region. A drawer is movably connected to the drawer support rails and moves between an open position extending from the cabinet and a closed position within said cabinet.

In accordance with another aspect of the invention, an insert panel for a cabinet comprises a generally planar inner surface including at least one support ridge protruding therefrom and vertically extending along a vertical axis from panel upper edge to a panel lower edge. The ridge has a V-shaped cross-section and includes a plurality of support notches formed therein and spaced-apart on the vertical axis. Each of the support notches includes a generally horizontally extending support surface or edge for supporting a drawer support rail.

In accordance with a further aspect of the present invention, a drawer cabinet includes first and second vertical side walls positioned on opposite cabinet lateral sides. Each sidewall includes a vertically extending support ridge extending at least substantially from a top edge to a bottom edge thereof. The ridge has a V-shaped cross-section and includes a plurality of drawer support notches formed therein. Each of the support notches comprises a generally horizontal drawer support region. The cabinet further includes a plurality of horizontally extending drawer support rails connected to each side wall. Each of the rails is supported by a support region of one of the plurality of support notches. A plurality of drawers are supported on opposite lateral sides by one of the plurality of horizontally extending support rails and move between a storage position and an open position.

One advantage of the present invention is that it provides a cabinet structure that is sufficiently rigid to support heavily loaded drawers.

Another advantage of the present invention is that it is easily assembled and cost-effective.

Still another advantage of the present invention is that the drawer support rails are more securely affixed to the cabinet inner walls.

A further advantage of the present invention is that it facilitates accurate horizontal placement of the drawer support rails.

Still other benefits and advantages of the present invention will become apparent to those of ordinary skill in the art upon reading and understanding the following detailed description of the preferred embodiment.

BRIEF DESCRIPTION OF THE DRAWINGS

The invention may take physical form in certain components and arrangements of components, preferred embodiments of which will be described in detail in this specification and illustrated in the accompanying drawings which form a part hereof and wherein.

DETAILED DESCRIPTION OF THE INVENTION

Figure 3:
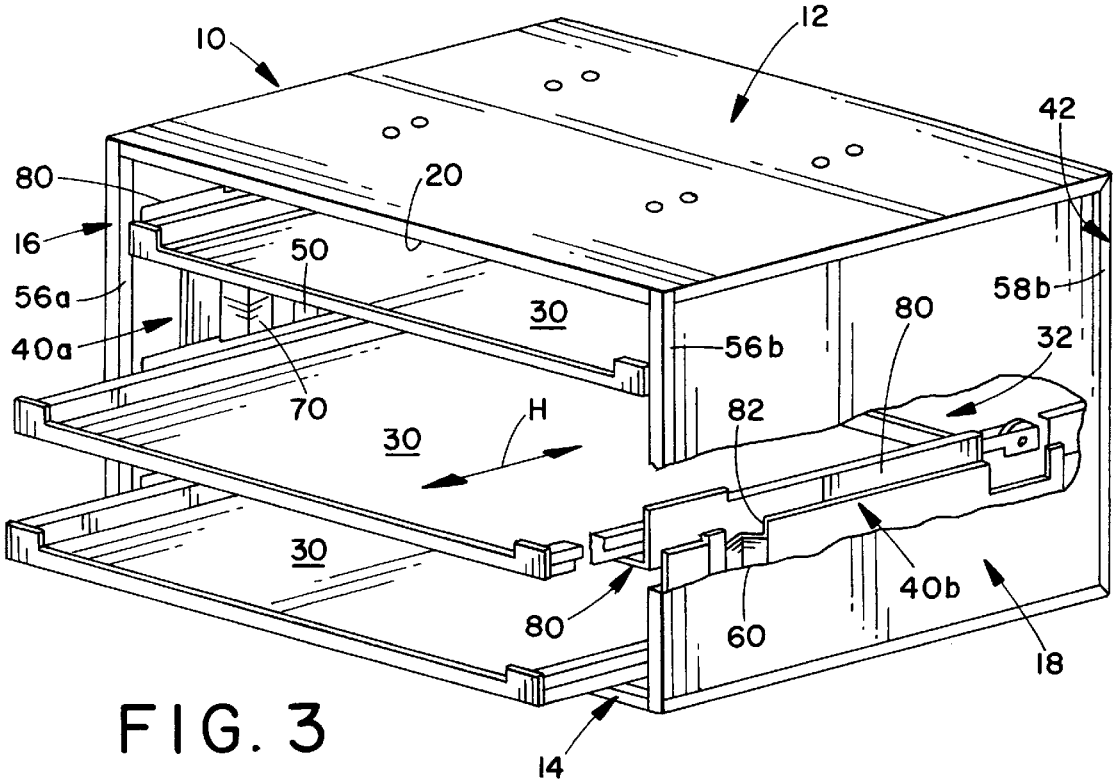
FIG. 3 is a perspective view, with portions broken away, of a cabinet structure including new and improved insert panel support structures in accordance with the present invention.
Figure 4:
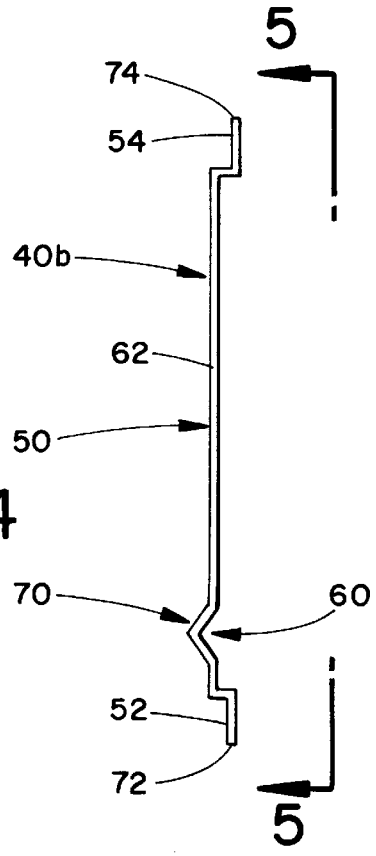
FIG. 4 is a top plan view of an insert panel support structure in accordance with the present invention.

Referring now to FIG. 3, a cabinet 10 in accordance with the present invention includes a top 12, a floor 14, and left and right outer side panels 16,18, respectively, positioned on opposite sides of cabinet. The left and right outer side panels 16,18, interconnect the cabinet top 12 and floor 14. The cabinet 10 includes an open front 20 and may include a rear panel (not shown).

Figure 1:
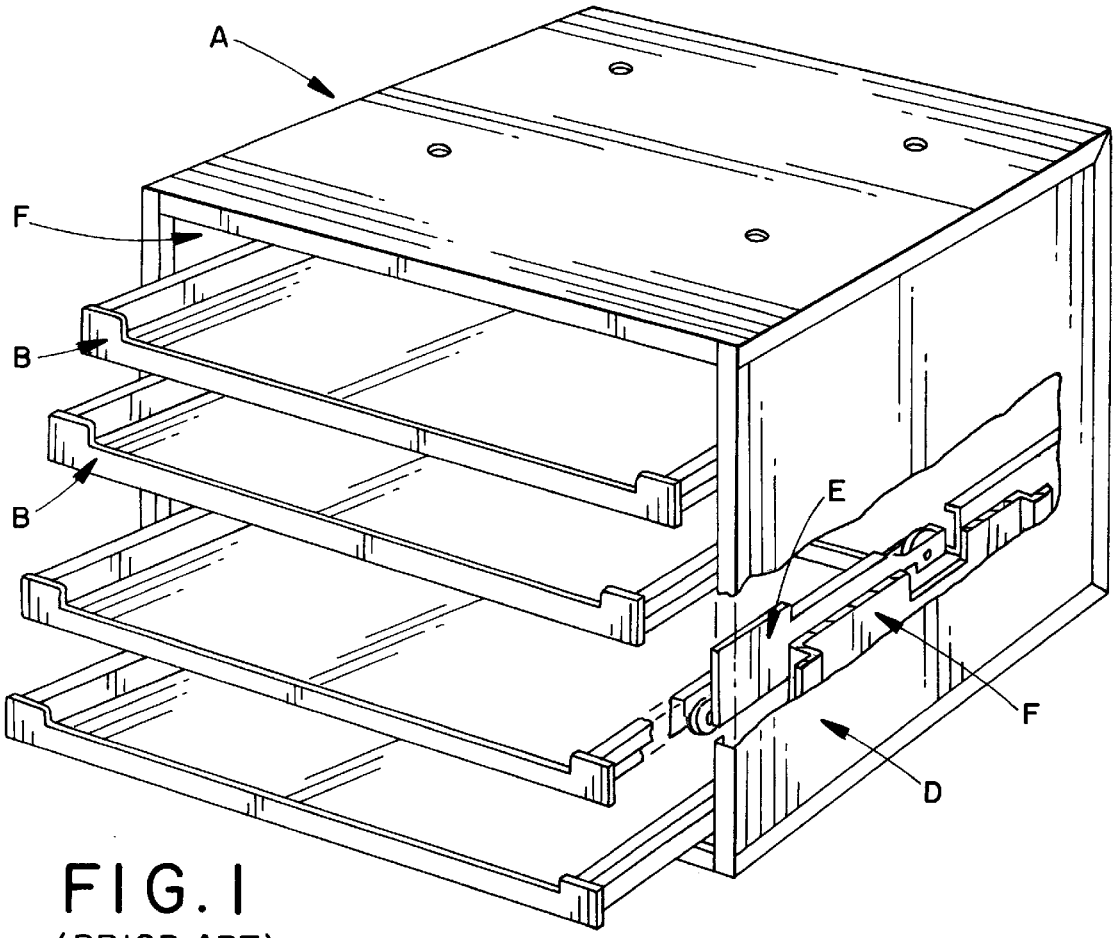
FIG. 1 (PRIOR ART)
FIG. 1 is a perspective view of a prior cabinet structure with portions broken away.
Figure 2:
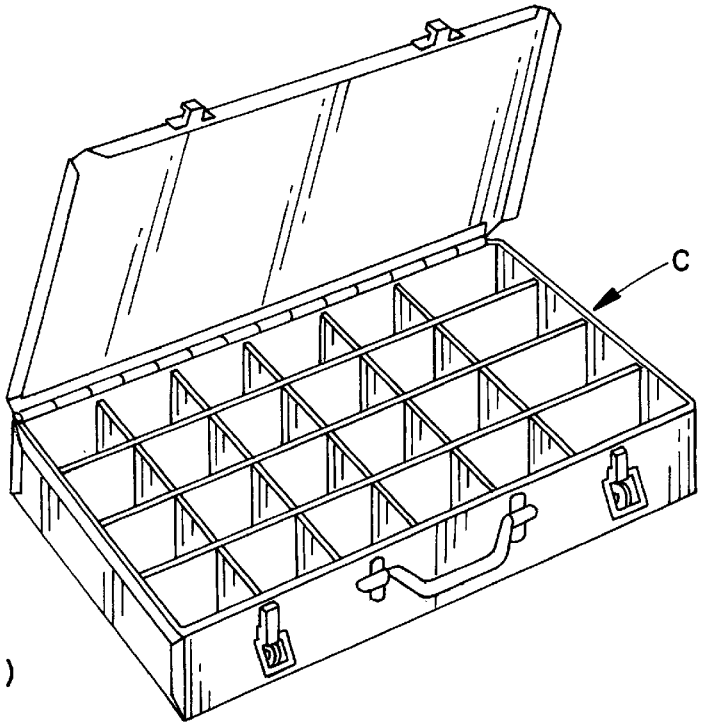
FIG. 2 (PRIOR ART)
FIG. 2 is a perspective view of a prior compartmentalized storage box.

One or more drawers 30 are supported in the cabinet interior 32. The drawers 30 are preferably slidable on a horizontal axis, as indicated by arrow H, between a storage position within the cabinet 10, and an extended "open" or access position. Each drawer 30 may include compartments or be adapted to receive a storage box C (FIG. 2).

In accordance with the present invention, a first insert panel support structure 40*a* is advantageously positioned inwardly adjacent the cabinet left side outer panel 16, and a second insert panel support structure 40*b* is correspondingly positioned inwardly adjacent the cabinet right side outer panel 18. Each panel extends at least substantially from the cabinet top 12 to the floor 14, and from the cabinet front region 20 to a cabinet rear region 42. Thus, the insert panels 40*a*,40*b* are generally coextensive with the left and right outer side panels 16,18, respectively. The insert panels 40*a*,40*b* are provided to support the one or more drawers 30 therebetween. Those of ordinary skill in the art will recognize that the left and right outer panels 16,18 are provided for aesthetic purposes and may be omitted.

FIGS. 4–7 depict an insert panel 40*b* in accordance with the present invention. The panel 40*a* is not individually shown, but those or ordinary skill in the art will recognize that the panel 40*a* is formed in the same manner as the panel 40*b* in accordance with the scope of spirit of the present invention. Each panel 40*a*,40*b* includes a planar inner surface 50 directed to the cabinet interior 32. As shown herein, each panel 40*a*,40*b* includes forward and rear mounting tabs or surfaces 52,54. The front tab 52 of each panel 40*a*,40*b* is engaged by a cabinet front frame member 56*a*,56*b*, respectively. Likewise, rear cabinet frame members (only 58*b* shown) engage the rear tab 54 of the panels 40*a*,40*b*, respectively. Preferably, the inner planar surface 50 of each insert panel 40*a*,40*b* is slightly offset toward the cabinet interior 32 relative to the tabs 52,54 for ease of installation of the panels 40*a*,40*b*, and for ease of attachment of the drawer support rails thereto as is described below.

Figure 5:
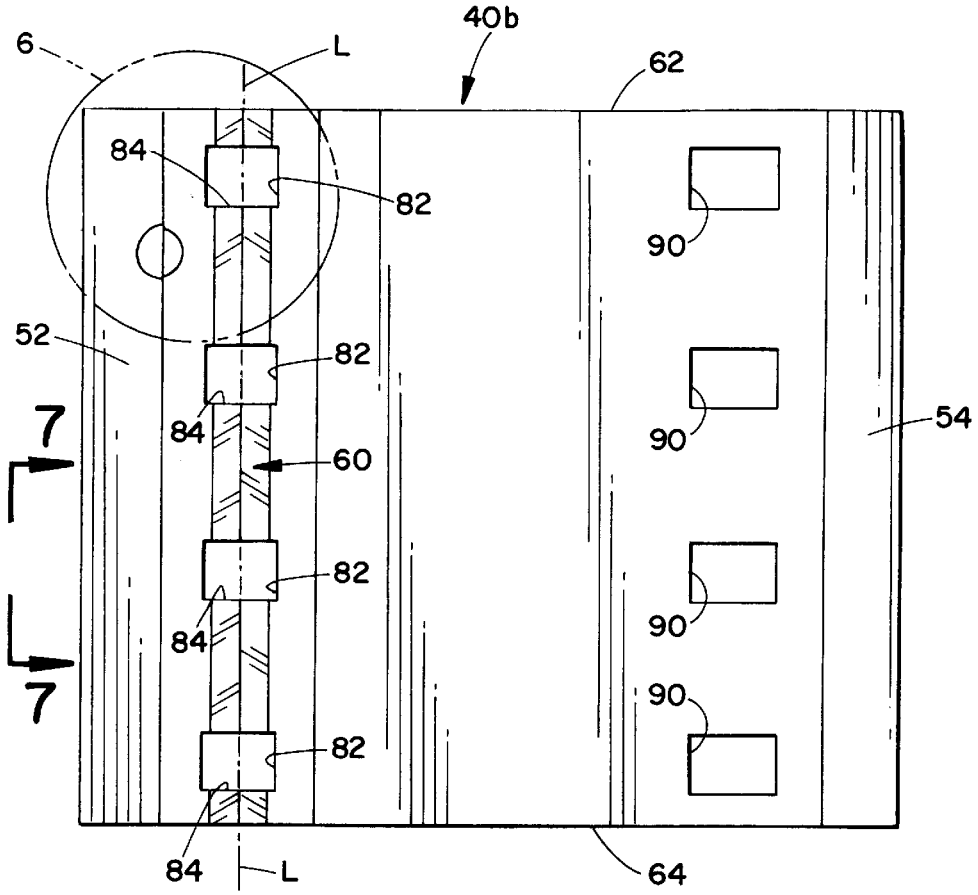
FIG. 5 is a side elevational view taken along line 5—5 of FIG. 4.
Figure 6:
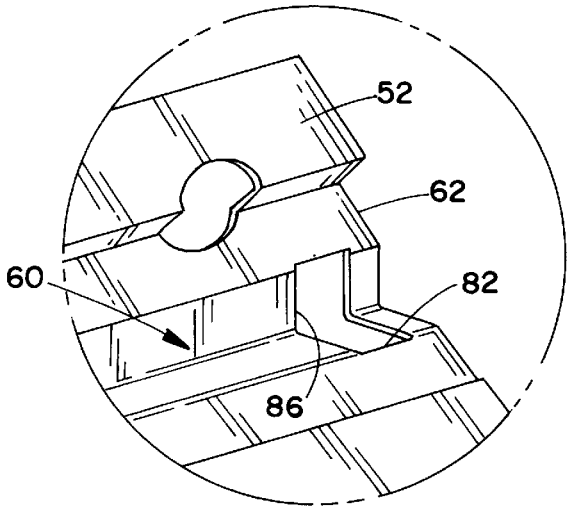
FIG. 6 is an enlarged perspective view of section 6 of FIG. 5.

With particular reference to FIG. 5, each insert panel 40*a*,40*b* includes a channel 60 defined in an outer surface thereof and extending from a panel top edge 62 to a panel bottom edge 64 along a vertical axis L. The channel 60 is preferably generally V-shaped in cross-section when the cross-section is taken in a plane perpendicular to the vertical axis L. More particularly, the channel walls converge toward the cabinet interior 32 to form the subject channel. As such, a V-shaped ridge 70 interrupts and projects or extends from the inner planar surface 50 of each panel 40*a*,40*b* toward the cabinet interior 32, and extends from the panel top edge 62 to the panel bottom edge 64. The ridge 70 provides significant added strength and rigidity to the panel 40*a*,40*b*, relative to a simple planar panel, so that the panel is able to support heavily loaded drawers 30 without flexing under the weight thereof. Preferably, the channel 60 is defined in each panel 40*a*,40*b* closer to the panel forward edge 72 than the panel rear edge 74, and most preferably, the channel 60 is defined in the forward 25% of the panel 40*a*,40*b*, such that the panel is able to support the weight of the drawers 30, even when the drawers are fully extended from the cabinet 10 in their open position. Also, those skilled in the art will recognize that each panel 40*a*,40*b* may include more than one V-shaped channel 60 defined therein.

Figure 7:
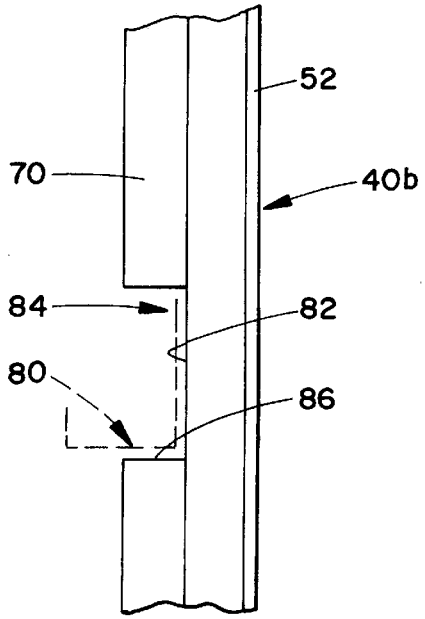
FIG. 7 is a partial front elevational view of the panel of FIG. 5 taken along line 7—7 and showing a drawer support rail in broken lines.

It can be seen in FIG. 3 that a plurality of drawer support rails 80 are positioned in the cabinet 10 and connected to the insert panels 40*a*,40*b* to movably support the drawers 30 in the cabinet 10 through rollers, sliders, or other suitable means. Each drawer 30 is supported by a pair of support rails 80, with the support rails 80 of each pair being affixed respectively to the panels 40*a*,40*b* (some rails 80 are not shown for clarity). To facilitate the effective interconnection of the rails 80 and the panels 40*a*,40*b*, a plurality of apertures 82 are formed through the V-shaped ridge 70 of each panel 40*a*,40*b*. The apertures 82 in the panels 40*a*,40*b* are aligned vertically with a corresponding aperture 82 in the other panel. The apertures are preferably rectangular in shape and vertically spaced along the axis L at locations corresponding to points where drawer support rails 80 are to be affixed to the panel 40*a*,40*b*. As such, each aperture 82 formed through the ridge 70 results in the formation of a rail support notch 84 in the V-shaped channel 70. As is best seen in FIG. 7, each support rail receiving notch includes a horizontally extending rail support region or edge 86 which vertically supports a drawer support rail 80 (shown in broken lines).

A rail 80 supported in a notch 84 extends horizontally between the panel front edge 72 and the panel rear edge 74, and lies adjacent the inner panel surface 50. Therefore, once supported in a notch 84, a rail 80 is easily spot-welded or otherwise suitably affixed to the panel 40*a*,40*b*, e.g., to the inner planar surface 50. Those of ordinary skill in the art will recognize that the horizontally extending edge 86 of each notch 84 supports the weight of a rail 80 positioned in the notch 84. As such, when a drawer supported by the rail 80 is heavily loaded, the edge 86 prevents excessive downward force on the relevant spot welds, which has heretofore been found to cause a failure thereof.

Each panel 40*a*,40*b* also preferably includes a plurality of alignment indicators such as apertures 90 formed therethrough in vertical alignment with the apertures 82 and horizontally spaced toward the panel rear edge 74. The alignment apertures 90 provide a means for visually verifying that a drawer support rail 80 is properly horizontally position once the rail is inserted into a notch 84. In particular, once a rail 80 is positioned in the notch 84, one assembling the cabinet adjusts the position of the rail until the rail extends horizontally from a notch 84 to an associated alignment aperture 90 located at the same vertical height as the subject rail receiving notch 84. Once the rail 80 is properly horizontally located, the spot-welding or other rail affixing operation is carried out to fix the position of the rail 80 relative to the panel 40*a*,40*b*.

The invention has been described with reference to the preferred embodiments. Obviously, modifications and alterations will occur to others upon a reading and understanding of the preceding specification. It is intended that the invention be construed as including all such modifications and alterations.

Having thus described the preferred embodiments, the invention is now claimed to be:

1. A cabinet structure comprising:

first and second inner side panels positioned respectively on opposite first and second lateral sides of said cabinet, each of said side panels including a generally vertical inner face and a vertically extending V-shaped ridge formed therein and converging toward an interior region of said cabinet structure, said V-shaped ridge of each panel having at least one drawer support rail receiving notch formed therein and defined to include a horizontally extending rail support edge extending from said panel vertical inner face inwardly toward said interior region of said cabinet and adapted for supporting a drawer support rail received in said notch;

at least first and second drawer support rails permanently affixed respectively to said first and second inner side panels, each of said rails positioned in one of said support rail receiving notches and supported on said horizontally extending rail support edge of said receiving notch so that each of said drawer support rails generally horizontally extends from a cabinet front region to a cabinet rear region and contacts said panel vertical inner face;

a drawer movably connected to said at least two drawer support rails and movable between an open position extending from said cabinet and a closed position within said cabinet.

2. The cabinet structure as set forth in claim 1 wherein said vertically extending V-shaped ridge of each of said first and second inner side panels is formed in a forward region of said panel, whereby said first and second V-shaped channels support a rear portion of said drawer when said drawer is in said extended open position.

3. The cabinet structure as set forth in claim 1 wherein said vertically extending V-shaped ridge of each of said first and second inner side panels includes a plurality of said drawer support rail receiving notches formed therein and vertically spaced apart from each other, said notches of said V-shaped ridge of said first panel being formed at a height corresponding to said notches of said V-shaped ridge of said second panel, respectively.

4. The cabinet structure as set forth in claim 3 wherein each of said first and second inner side panels includes a plurality of apertures formed through a rear region thereof, said plurality of apertures vertically spaced such that at least one aperture is horizontally aligned with each of said drawer support rail receiving notches, whereby each of said apertures facilitates the horizontal alignment of a drawer support rail received in said corresponding horizontally aligned support rail receiving notch.

5. An insert panel for a cabinet, said insert panel comprising:

a generally planar inner surface including at least one support ridge protruding outwardly therefrom in a first direction and extending along a vertical axis from an upper edge region of said panel to a lower edge region of said panel, said at least one ridge having a V-shaped cross-section and including a plurality of rail support notches formed therein and spaced-apart on said vertical axis, each of said rail support notches including a support surface extending horizontally and in the first direction away from said planar inner surface; and, a plurality of drawer support rails horizontally extending adjacent and in contact with said planar inner surface on an axis perpendicular with said vertical axis, each of said rails received in one of said support notches and supported by said horizontally extending support surface thereof and fixedly secured to said planar inner surface.

6. The insert panel as set forth in claim 5 wherein a plurality of apertures are formed therethrough, each of said apertures horizontally spaced from and vertically aligned with a corresponding one of said support notches formed in said V-shaped ridge to provide visual alignment means for horizontally aligning said drawer support rail supported in said corresponding one of said support notches.

7. The insert panel as set forth in claim 5 wherein each of said drawer support rails is permanently affixed adjacent said generally planar inner surface by at least one spot-weld.

8. A drawer cabinet comprising:

first and second vertical side walls positioned on opposite cabinet lateral sides, each sidewall including a planar inner face having a vertically extending support ridge defined therein and extending substantially from a top edge to a bottom edge thereof, said ridge having a V-shaped cross-section that converges away from said planer inner face toward the other of the first and second side walls and including a plurality of drawer support notches formed therein, each of said support notches comprising a generally horizontal drawer support region extending outwardly from said planar inner surface toward the other of the first and second side walls and adapted for supporting a drawer support rail inserted into said notch;

a plurality of horizontally extending drawer support rails connected to each side wall, each of said rails supported by said horizontally extending support region of one of said plurality of support notches so that said rail lies adjacent and contacts said planar inner face; and, a plurality of drawers, each of said drawers supported on opposite lateral sides by one of said plurality of horizontally extending support rails and movable between a storage position and an open position.

* * * * *